US007237626B2

(12) United States Patent
Gurjar et al.

(10) Patent No.: US 7,237,626 B2
(45) Date of Patent: Jul. 3, 2007

(54) TOOL MODULE CONNECTOR FOR USE IN DIRECTIONAL DRILLING

(75) Inventors: Rishi Gurjar, Edmonton (CA); Michael T Sutherland, Calgary (CA); Karim Kanji, Calgary (CA)

(73) Assignee: Ryan Energy Technologies, Calgary, Alberta (CA)

( * ) Notice: Subject to any disclaimer, the term of this patent is extended or adjusted under 35 U.S.C. 154(b) by 247 days.

(21) Appl. No.: 10/516,909

(22) PCT Filed: Jun. 5, 2003

(86) PCT No.: PCT/CA03/00844

§ 371 (c)(1),
(2), (4) Date: May 18, 2005

(87) PCT Pub. No.: WO03/104606

PCT Pub. Date: Dec. 18, 2003

(65) Prior Publication Data

US 2005/0205304 A1 Sep. 22, 2005

Related U.S. Application Data

(63) Continuation-in-part of application No. 10/164,266, filed on Jun. 5, 2002, now abandoned.

(51) Int. Cl.
*E21B 17/02* (2006.01)

(52) U.S. Cl. ..... 175/320; 166/65.1

(58) Field of Classification Search ..... 175/75, 175/320, 309; 166/65.1, 242.1, 242.6, 241.1
See application file for complete search history.

(56) References Cited

U.S. PATENT DOCUMENTS

| | | | | |
|---|---|---|---|---|
| 2,706,616 | A * | 4/1955 | Osmun | 175/297 |
| 3,285,629 | A * | 11/1966 | Cullen et al. | 285/119 |
| 4,016,943 | A * | 4/1977 | Cullen et al. | 175/65 |
| 4,265,305 | A | 5/1981 | Holcomb et al. | |
| 4,496,203 | A * | 1/1985 | Meadows | 439/194 |
| 4,500,156 | A * | 2/1985 | Nguyen | 439/275 |
| 4,585,287 | A * | 4/1986 | Ramsey et al. | 439/588 |
| 4,660,910 | A | 4/1987 | Dieken et al. | |
| 4,874,327 | A | 10/1989 | Ip | |
| 5,725,061 | A * | 3/1998 | Van Steenwyk et al. | 175/104 |
| 6,158,532 | A | 12/2000 | Dopf et al. | |
| 6,484,801 | B2 * | 11/2002 | Brewer et al. | 166/65.1 |

FOREIGN PATENT DOCUMENTS

| | | |
|---|---|---|
| WO | WO 95/22679 A | 8/1995 |

* cited by examiner

*Primary Examiner*—Kenneth Thompson
(74) *Attorney, Agent, or Firm*—Barnes & Thornburg LLP

(57) ABSTRACT

A tool module interconnect (10) for interconnecting to adjoining modules for insertion in a drill string features a system which permits making the electrical interconnection before assembly of the mechanical connections to interconnect the tool modules together. The interconnect comprises a hollow interconnect body (18) open at both ends. A wire harness (18) is provided in the hollow body with terminal end connectors (26, 28) accessible from the respective open end of the interconnect body. The interconnect is adapted for attachment to adjoining modules, where at least one end has a rotatable threaded sleeve (24) for connection to a tool module by a threaded collar.

15 Claims, 11 Drawing Sheets

74
76
78
16
80
73
96
126
18
132
142
94
88
86
90
92
84
24
140
82
138

96
73
24
16
51
52
20
130
134
30
9
10
132
135

9
100
98
136
22
132
73
96
24
16
10
130
134

TOOL MODULE CONNECTOR FOR USE IN DIRECTIONAL DRILLING

RELATED APPLICATION

This Application is the National filing of International Application No. PCT/CA03/00844, filed Jun. 5, 2003 claiming priority from and being a continuation-in-part of U.S. patent application Ser. No. 10/164,266, filed Jun. 5, 2002 now abandoned.

FIELD OF THE INVENTION

This invention relates to a tool module interconnect for use in drill strings, particularly directional oil well drilling strings.

BACKGROUND OF THE INVENTION

It has been recognized for some time that an interconnect is necessary to connect tool modules for insertion in a drill string. The tool electronic components, which measure various parameters while drilling is proceeding, are housed in rigid tubular members to form tool modules. The directional drilling necessitates curving of the drill string as it proceeds with drilling of the oil well. Hence an interconnect is needed to provide for curving of the tool modules within the drill string. The interconnects are formed in a way that they may curve to accommodate the curvature in the drill string.

Interconnects are designed for a high pressure hydraulic environment, necessitating a system of tight seals to avoid invasion of drilling mud within the tool module. One example of a tool interconnect is sold by Tensor Corporation. The system is prone to leaking, and susceptible to electrical failure from a variety of mechanical loads experienced in aggressive drilling environments.

It is an object of an aspect of this invention to provide for tool module interconnect which isolates the electrical connection from mechanical loads generated in the course of drilling operations, while providing a sealing system that is rugged and withstands the harsh drilling environments.

SUMMARY OF THE INVENTION

In accordance with an aspect of the invention, a tool module interconnect for interconnecting adjacent tool modules for insertion in a drill string, the interconnect comprises:

an interconnect body;

a means for connecting said interconnect body to adjacent tool modules, wherein said means for connecting said interconnect body to adjacent tool modules comprises at least one rotatable threaded sleeve, said rotatable threaded sleeve being adapted for threaded connection to one of said adjacent tool modules;

an interlock on an end of said interconnect body corresponding to said rotatable threaded sleeve, said interlock engaging said interconnect body end with one of said tool modules; and a wire harness in a longitudinal bore of said interconnect body having at each terminal end connectors where each said connector is floating, unrestricted and accessible from its respective end of the interconnect body;

said interconnect serving to separate the connector from the interconnect body to reduce the transfer of operational stresses and shock to the electrical components of the interconnect.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
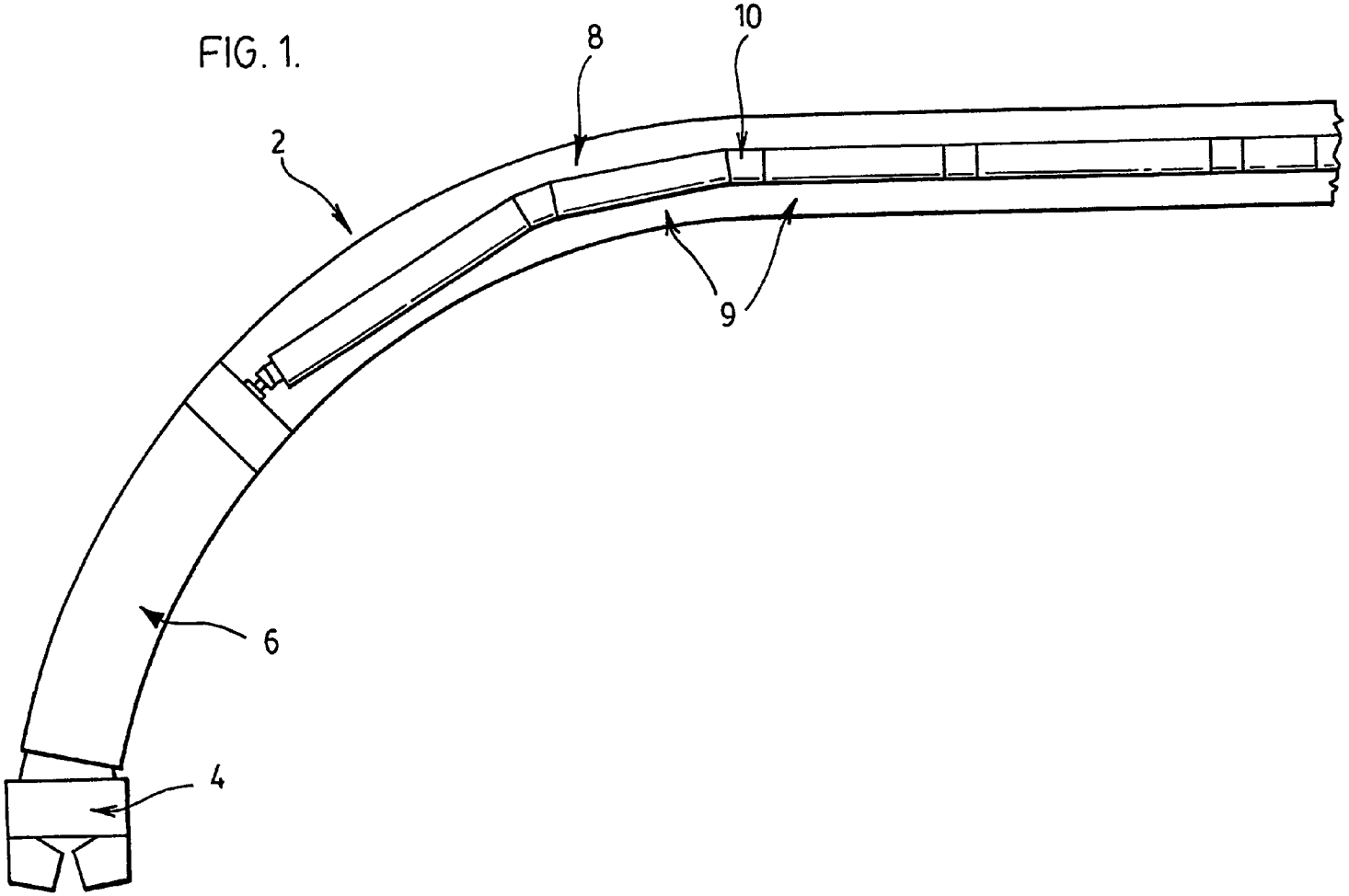
FIG. 1 is a schematic of a conventional drill string curve during a directional drilling operation.

FIG. 1 shows a conventional drill string (2) used in directional drilling applications. Directional drilling allows for non-linear drilling operations, where the operator is able to steer the drill string by means of a multi-positionable drill bit (4). This creates a borehole with curves leading in operator-defined directions through which the drill string proceeds. The drill string (2) follows the curvature of the borehole. Adjacent to the drill bit (4) is the region containing the motor assembly (6). Also contained within the drill string (2) is a tool string (8) made up of multiple tool modules (9). The tool modules (9) are not flexible and require an electrical/mechanical connector that allows for the tool string (8) to bend within and follow the curvature of the drill string (2). The invention provides a tool module interconnect (10) that can be used to connect both electrically and mechanically, two tool modules (9) in series and offers the required flexibility when placed within a directional drill string.

Figure 2:
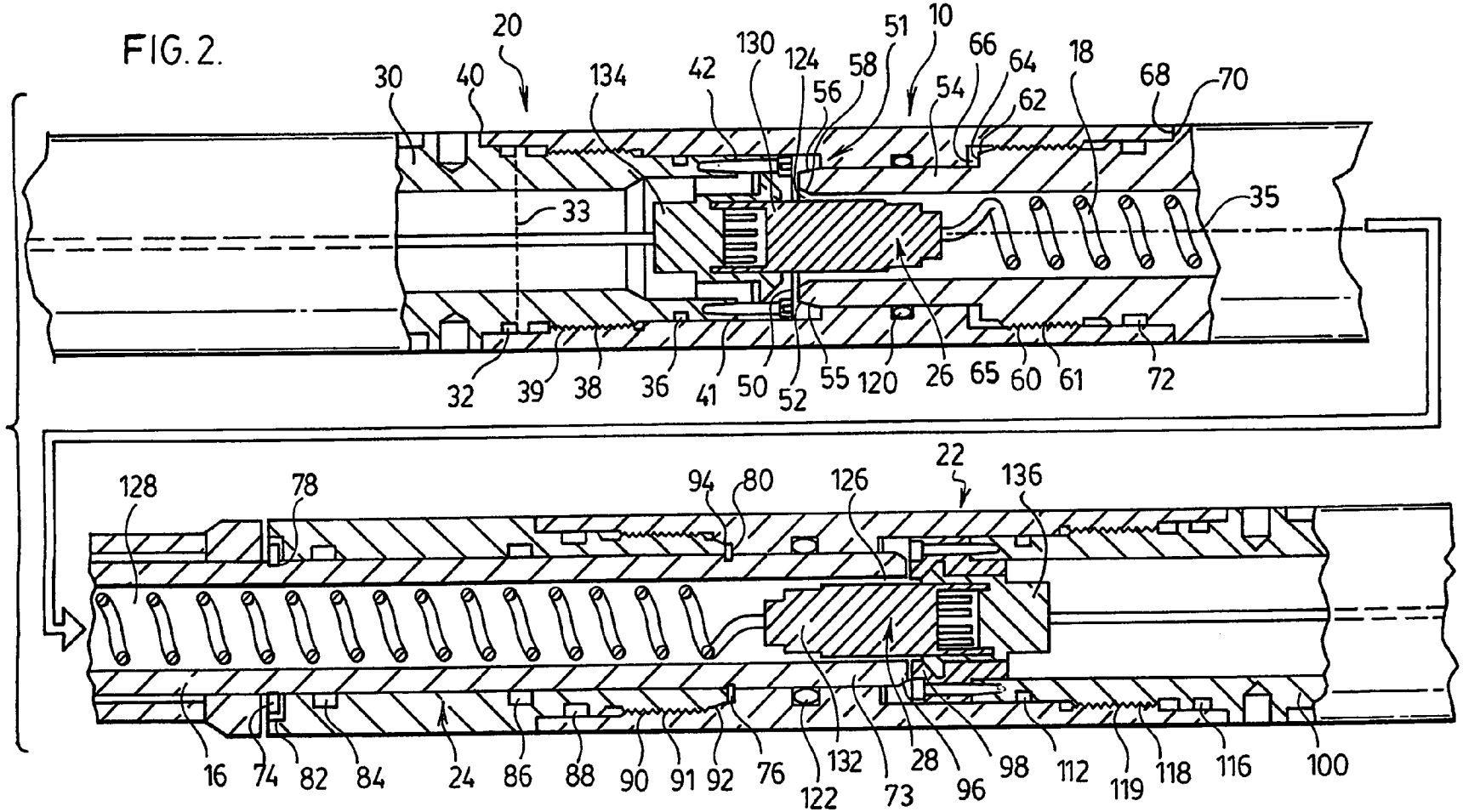
FIG. 2 is a cross-sectional plan view of a tool module interconnect with tool modules connected on either end.

Shown in FIG. 2 is a cross-sectional view of the tool module interconnect (10) in accordance with a preferred embodiment of the invention. The device comprises an interconnect body (16), a wire harness (18) and threaded collars (20, 22) positioned at each end of the interconnect body (16). The device further comprises a rotatable threaded sleeve (24) spaced from one end of the interconnect body and electrical interconnect devices (26, 28) located at each end of the interconnect body.

A tool module bulkhead (30) is shown in FIG. 2 to illustrate a preferred embodiment for the connection between the module and the interconnect. The tool module bulkhead (30) is of circular cross-section and on its outer surface has multiple circumferential box-shaped channels (32, 36) machined with the plane (33) of each channel being perpendicular to the longitudinal axis shown in dot (35). Contained within the multiple box-shaped circumferential channels (32, 36) are O-rings that serve to prevent drilling mud from entering the interconnect and tool module assembly. The tool module bulkhead (30) has a threaded region (38) that threadably engages the corresponding threaded region (39) of the threaded collar (20) during assembly such that the bulkhead (30) and the threaded collar (20) abut at (40). On the end face (41) of the tool module bulkhead is the flat flange assembly (50), further details of which are provided in FIG. 9.

At end (51) of the interconnect body (16) is a flat face (52) that is adjacent to the flat flange assembly (50), preferably with a spacing to accommodate any relative movement during operation due to torsion or bending. It is preferred that the interconnect body (16) is a unitary structure (54) of circular cross-section with the terminal end (55) being chamfered on both the external (56) and internal (58) faces to facilitate the assembly process. Close to the end of the interconnect body (16) is a threaded region (60) that threadably engages a corresponding thread (61) on the threaded collar (20). Adjacent to the threaded region (60) on the side towards the flat face (52) is a chamfered shoulder (62). The vertical flat face (64) of the chamfered shoulder (62) and vertical shoulder (65) of threaded collar (20) defines in part a space (66) to allow abutment of the threaded collar interconnect shoulder (68) with the tool module interconnect shoulder (70) to ensure a complete fit and a smooth exterior profile of the assembly. Situated on the outer surface of the interconnect body (16) is a circumferential box-shaped channel (72) designed to receive an O-ring for sealing the assembly.

The rotatable threaded sleeve (24) is retained in position by means of c-shaped clips (74, 76) that are received by circumferential grooves (78, 80), the plane of each c-clip being aligned perpendicular to the longitudinal axis of the device, on the outside surface of the interconnect body (16). This arrangement permits the threaded sleeve to rotate about the longitudinal axis without longitudinal movement. On the end of the rotatable threaded sleeve (24) corresponding to the side most distant from the interconnect body end (73) is a circumferential shoulder (82) within which the above mentioned c-shaped clip (74) is situated. On the inside surface of the threaded sleeve are circumferential box-shaped channels (84, 86), aligned perpendicular to the longitudinal axis of the interconnect body, that are designed to receive O-rings for the purpose of sealing the device and the associated tool modules from the drilling mud. Also located on the rotatable threaded ring (24) is a circumferential box-shaped channel (88) on the outer surface designed to receive an O-ring for sealing the assembly from drilling mud. Adjacent to the channel (88) is a threaded region (90) that terminates at a chamfered shoulder (92) on the terminal end of the threaded ring. The threaded region (90) corresponds to a thread (91) on the inner surface of threaded collar (22). Adjacent to the terminal end face of (94) of the threaded ring (24), is a c-shaped clip (76).

Figure 4:
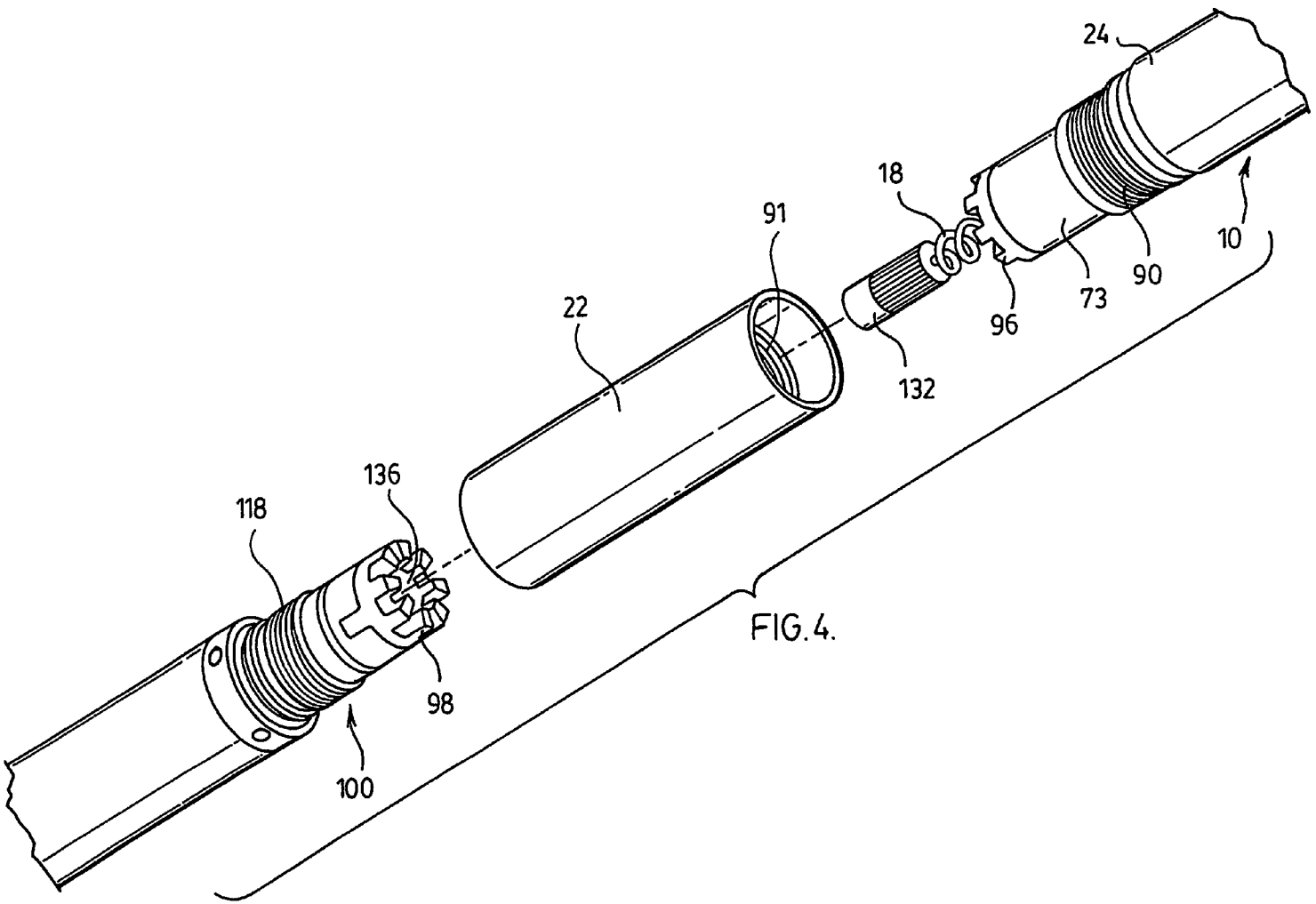
FIG. 4 is an exploded perspective view of the castellated end of a tool module interconnect and associated tool module.

Situated on the terminal end of the interconnect body (16) opposite the end with the flat face (52) is a castellated end (96; see also FIG. 4). The castellated end (96) mates with the castellated flange assembly (98) that is attached to a second tool module bulkhead (100) by a means further detailed in FIG. 10. The mated castellated ends provides a means to prevent rotational movement of the interconnect body about the longitudinal axis (35) resulting from torsional stress. On the second tool module bulkhead are circumferential box-shaped channels (112, 116), aligned perpendicular to the longitudinal axis of the device, that receive O-rings for sealing the assembly from drilling mud. Also located on the second tool module is a threaded region (118) that threadably engages a corresponding threaded region (119) on the threaded collar (22). The threaded collars (20, 22) are used to assemble the interconnect (10) to the first and second tool module bulkheads (30, 100). Located on the inner surface of the threaded collars (20, 22) is a circumferential channel (120, 122) designed to receive an O-ring for sealing the device from drilling mud.

Situated at each end (51, 73) of the interconnect body (16) is a circular opening (124, 126) of the same diameter as the longitudinal bore (128) extending through the length of the interconnect body (16). It is appreciated that the shape of the longitudinal bore may vary over its length, in other words, the interconnect body is hollow. Situated proximal to the circular opening are the electrical interconnects consisting of a plug connector (130, 132) and a socket connector (134, 136). The socket connectors (134, 136) are fixed to the tool module bulkheads by means of the appropriate flange assembly. Further details regarding the flange assembly are provided in FIGS. 9 and 10. The plug connectors (130, 132) are attached to a wire harness (18) that extends the length of the longitudinal bore (128). In a preferred embodiment, the wire harness (18) is a wire coil that can be extended yet will recoil so as to pull the wire back into the longitudinal bore and as well retracts the plug connector back towards and perhaps into the openings (124, 126). The plug connectors (130, 132) are floating and unrestricted by the circular opening (124, 126) such that the plug connectors (130, 132) are free to move inward and outward of the circular opening (124, 126) as required. The extendibility of the coiled-wire harness and plug connector assembly allows for the plug connectors (130, 132) to be extended beyond the circular opening (124, 126) and external to the interconnect body (16) to facilitate connection with the mating socket connectors (134, 136) during tool string assembly. The retractability of the coiled-wire harness serves to simplify tool string assembly as the coiled wire harness self-guides back into the longitudinal bore (128) of the interconnect body. It is appreciated that a suitable clip or clips may be used to retain the wire harness.

In an alternate embodiment, the tool module interconnect is furnished with rotatable threaded sleeves of the type described in the first embodiment at both ends of the interconnect body. This embodiment would permit the attachment or disassembly of the tool string without rotation of the interconnect body about the longitudinal axis. Castillated ends are preferably provided at both ends in this embodiment.

In another alternate embodiment, the tool module interconnect is furnished with both terminal ends being flat (uninterlocked) and of the type described in the first embodiment. In this alternative embodiment, some other device is required to prevent twisting of the wire harness such as a rotatable connector, or alternatively, the wire is wound in the opposite direction so that, in adding the threaded collar/tool module assembly, the wire assumes normal position.

In yet another alternate embodiment, the tool module interconnect is furnished with an interconnect body which may be assembled from parts in a manner apparent to one skilled in the art so as to provide a complete structure capable of performing the same task as the unitized structure described in the first embodiment.

Figure 3:
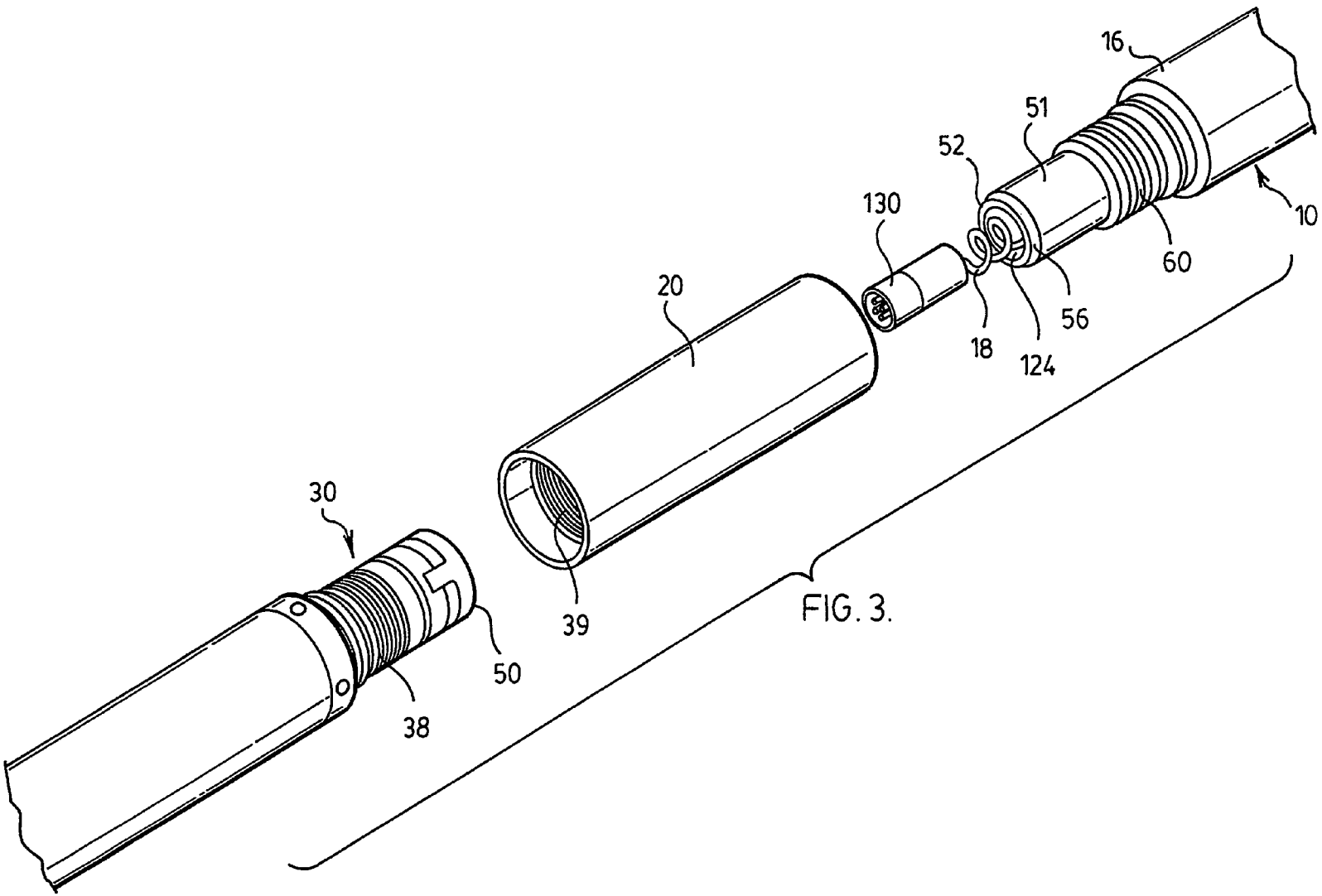
FIG. 3 is an exploded perspective view of the flat end of a tool module interconnect and the associated tool module.

FIG. 3 shows an exploded view of the flat end (51) of the tool module interconnect (10). The figure shows the plug connector (130) extending beyond the circular opening (124) of the flat end (51) of the interconnect body (16). An electrical connection is established by extending the plug connector (130) through the threaded collar (20) and plugging the plug connector (130) into the receiving connector socket (134; not shown) which is attached to the tool module bulkhead (30) by means of the flat flange assembly (50).

FIG. 4 shows an exploded view of the castellated end (96) of the tool module interconnect (10). The plug connector (132) extends beyond the castellated end (96), external to the interconnect body (16). An electrical connection is established by extending the plug connector (132) through the threaded collar (22) and plugging the plug connector (132) into the receiving connector socket (136) which is attached to the tool module bulkhead (100) by means of the castellated flange assembly (98).

Figure 5A:
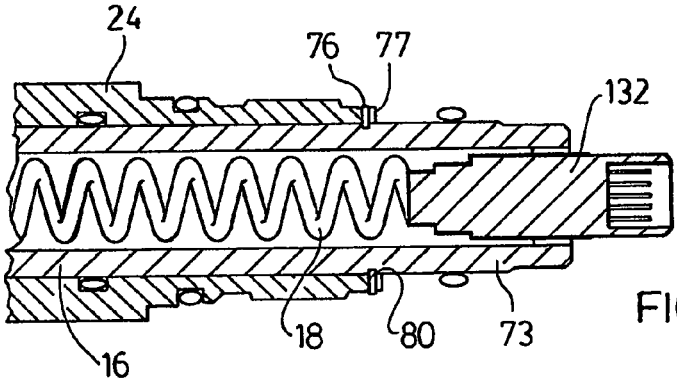
FIG. 5A is a cross-sectional plan view showing placement of a retainer ring for ensuring securement of the rotatable threaded sleeve.
Figure 5B:
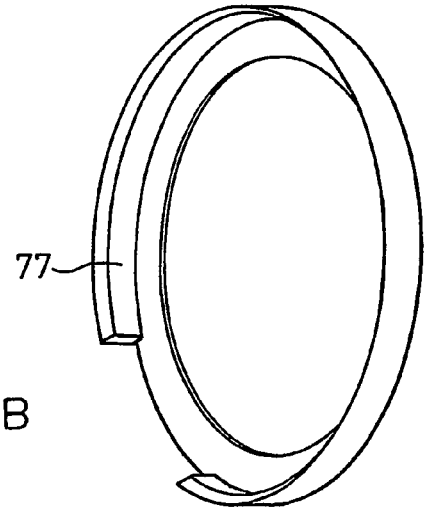
FIG. 5B is a perspective view of the retainer ring of FIG. 5A.
Figure 5:
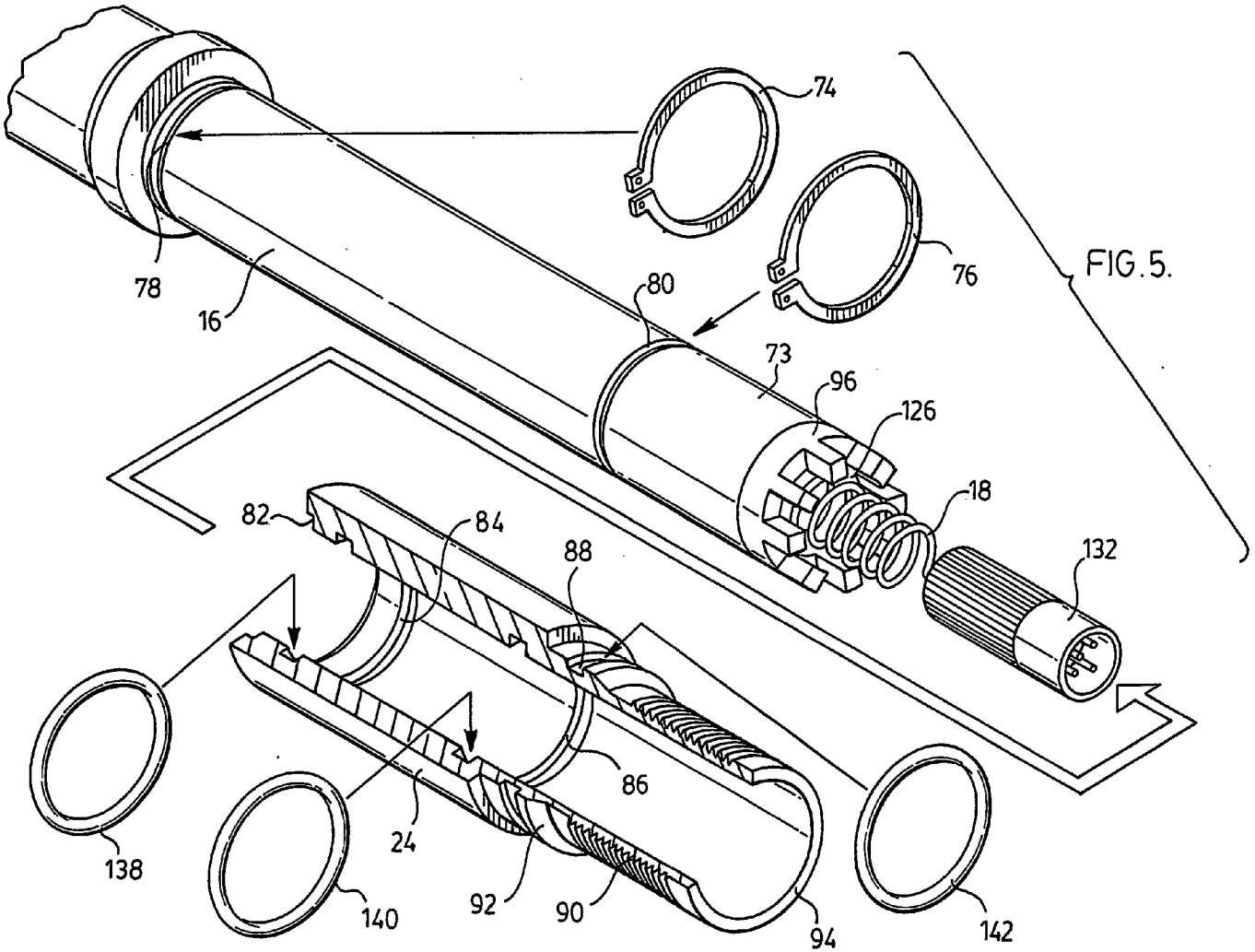
FIG. 5 is an exploded perspective view partly in section of a rotatable threaded sleeve assembly on the castellated end of the tool module interconnect.

FIG. 5 shows an exploded view of the threaded sleeve assembly at one end (73) of the interconnect body (16). Shown is the threaded sleeve (24) and the placement of the retaining c-shaped clips (74, 76) into the respective circumferential box-shaped groove (78, 80) on the interconnect body. The plug connector (132) is shown extending beyond the circular opening (126) of the castellated end (96). Also shown in this figure are the O-rings (138, 140, 142) that are placed in respective circumferential box-shaped grooves (84, 86, 88) for the purpose of sealing the tool string from ingress of drill mud into the hollow body.

Figure 3A:
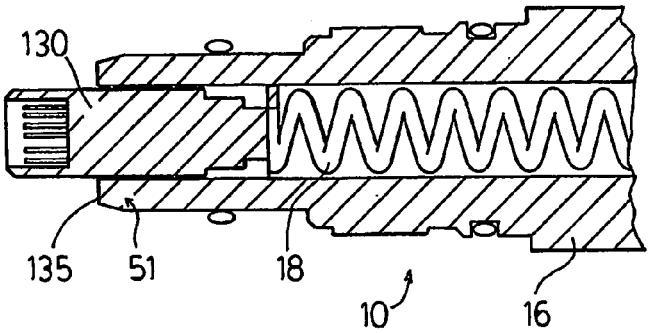
FIG. 3A is a cross-sectional plan view showing the use of a terminal end connector sleeve for ensuring integrity of the tool module interconnect.
Figure 3B:
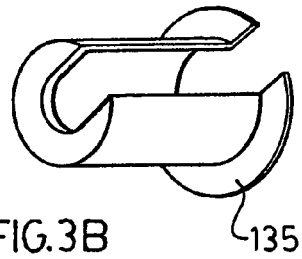
FIG. 3B is a perspective view of the terminal end connector sleeve of FIG. 3A.

The tool module interconnect is optionally furnished with terminal end connector sleeves (FIGS. 3A and 3B) to prevent the plug connectors (130, 132) from disconnecting from the respective receiving connector sockets (134, 136) during heavy use. FIG. 3A shows terminal end connector sleeve (135), fitted on the flat end (51) of the tool module interconnect (10). The terminal end connector sleeve (135) provides a rear stop that prevents the plug connector (130) from retracting back into the longitudinal bore (128) of the interconnect body (16).

As shown in FIG. 5A, the threaded sleeve assembly may further comprise a retainer ring (77; see FIG. 5B) fitted over the c-shaped clip (76) to prevent the clip from expanding and disconnecting from the circumferencial box-shaped groove (80) on the interconnect body (16). This provides added assurance that threaded sleeve (24) is retained in position during heavy use.

Figures 6A, 6B, 6C:
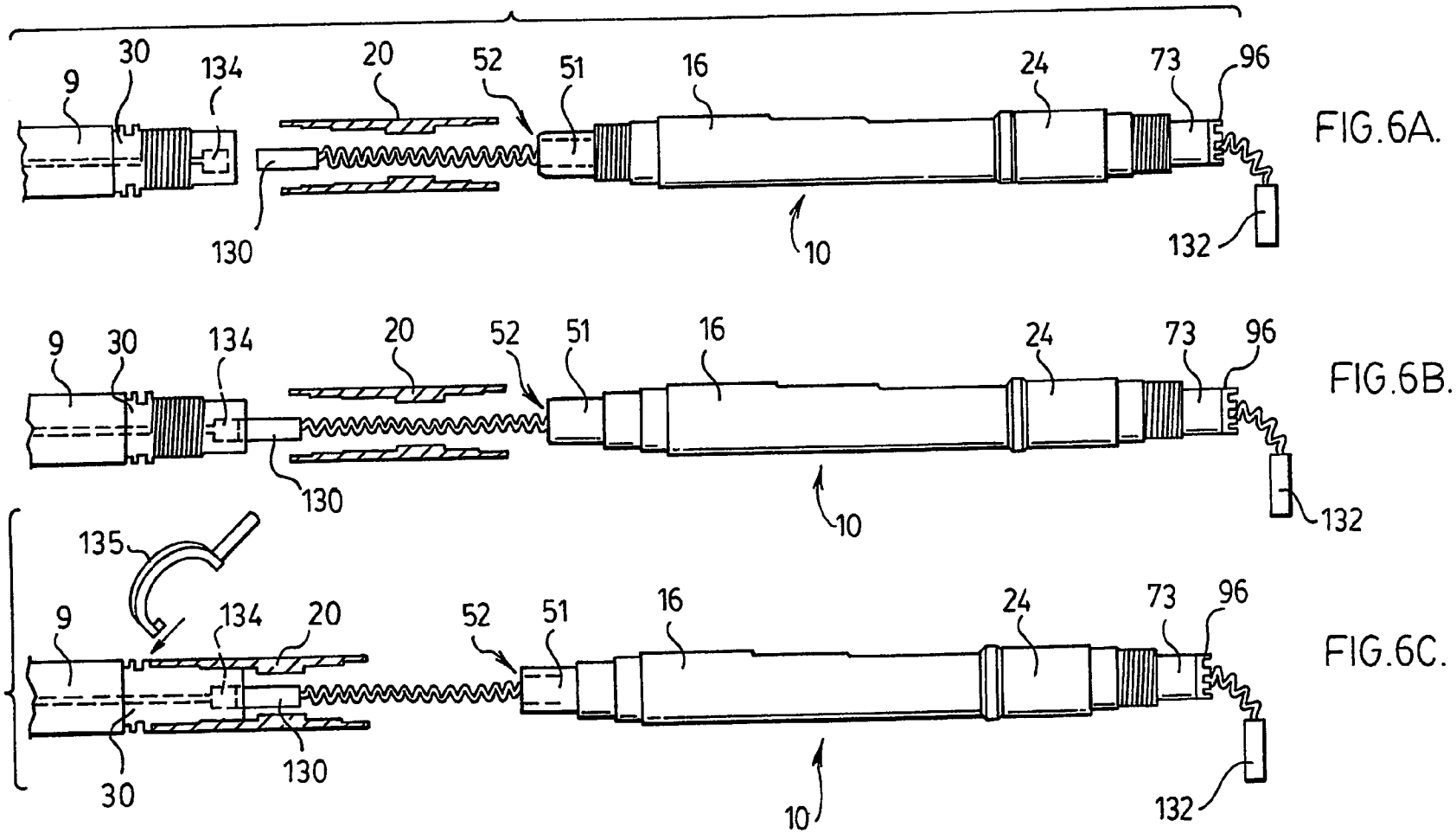
FIGS. 6A to 6F are partial sectional views showing the assembly connection assembly of two tool modules to a tool module interconnect.
Figures 6D, 6E, 6F:
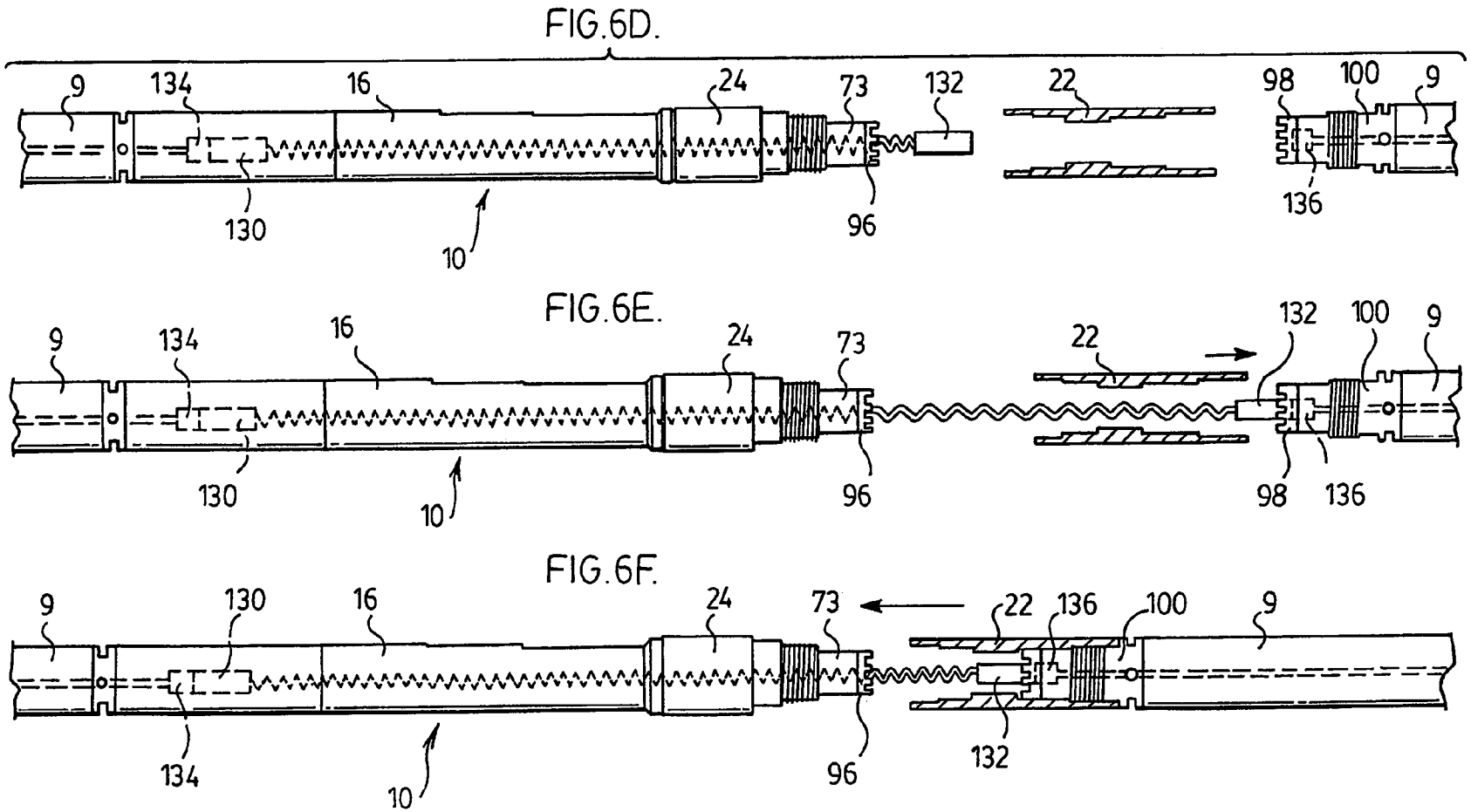

FIGS. 6A through 6F show the sequence of events during assembly of a tool string using the tool module interconnect (10). In FIG. 6A, the plug connector (130) is extracted from the flat end (51) of the interconnect body (16). The extendible wire harness allows for the plug connector (130) to be extended beyond the flat end (51) and passed through and beyond the threaded collar (20). In FIG. 6B, the extended plug connector (130) is mated with the receiving socket connector (134) on the tool module bulkhead (30). The threaded collar (20) is then connected to the tool module bulkhead (30) as illustrated in FIG. 6C by the use of tool (135). To complete the first connection of the tool module interconnect to the first tool module, the tool module interconnect is rotated for threadable attachment to the threaded collar creating the assembly illustrated in FIG. 6D. Also shown in FIG. 6D is the plug connector (132) being extracted from the other end (73) of the interconnect body (16), beyond the castellated end (96). As illustrated in FIG. 6E, the plug connector (132) is passed through the threaded collar (22) and mated with the corresponding socket connector (136) on the tool module bulkhead (100). The threaded collar (22) is then attached to the tool module bulkhead (100). The final assembly step is illustrated in FIG. 6F. The second tool module/threaded collar assembly is joined to the tool module interconnect and threadably engaged by rotating the rotatable threaded sleeve (24) using a pipe wrench or tool (135) if equipped with a blind bore. The castellated end (96) of the interconnect body (16) and the castellated flange assembly (98) of the tool module bulkhead (100) prevent relative rotation about the longitudinal axis of either the tool module interconnect or the tool module itself.

Figure 7:
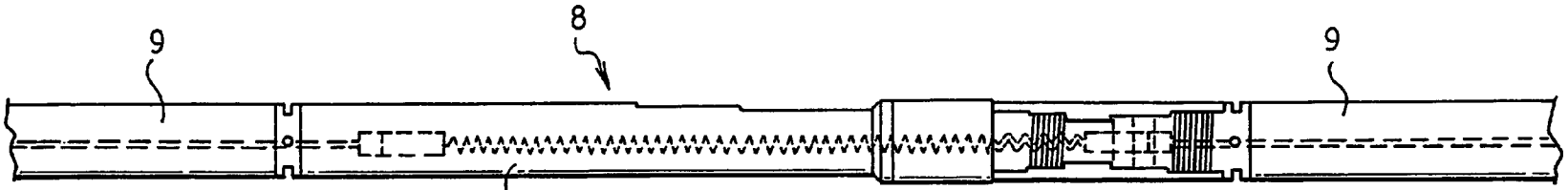
FIG. 7 is partial section view showing the tool module interconnect connecting two tool modules.

FIG. 7 shows the assembled tool string (8) comprising two tool modules (9) connected in series by means of the tool module interconnect (10). The assembled tool string (8) is both mechanically and electrically connected and is ready for use within a drill string being used in non-linear directional drilling operations.

Figure 8:
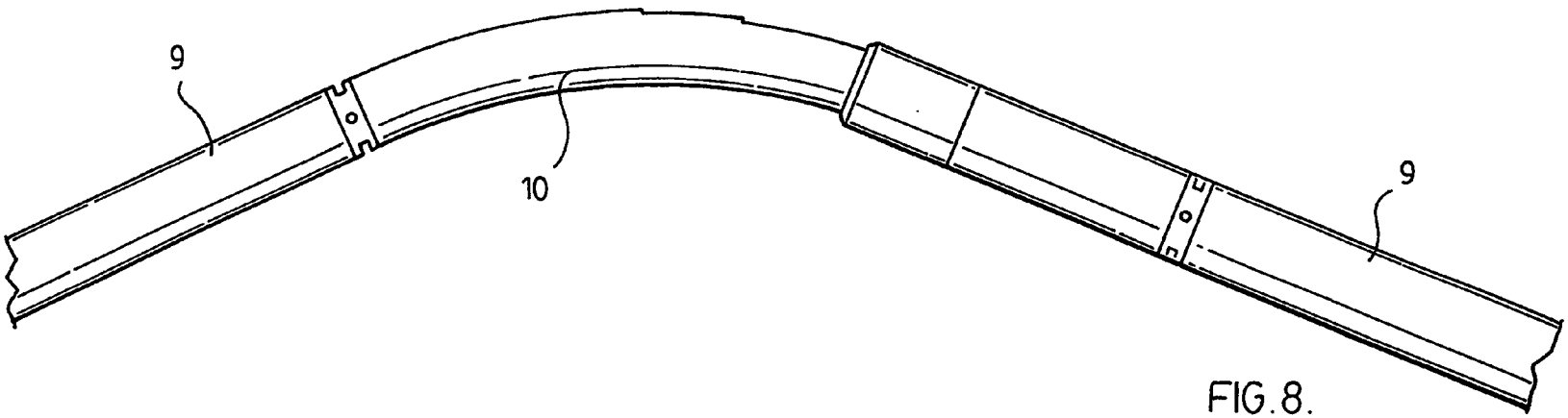
FIG. 8 is a plan view showing a tool string curved in a manner as installed in a curved drill string of FIG. 1.

FIG. 8 shows the assembled tool string (8) as it may appear when installed within a drill string that is passing through a curved borehole. The tool module interconnect (10) provides the necessary bending within the drill string when a non-linear section of the borehole is encountered.

Figure 9:
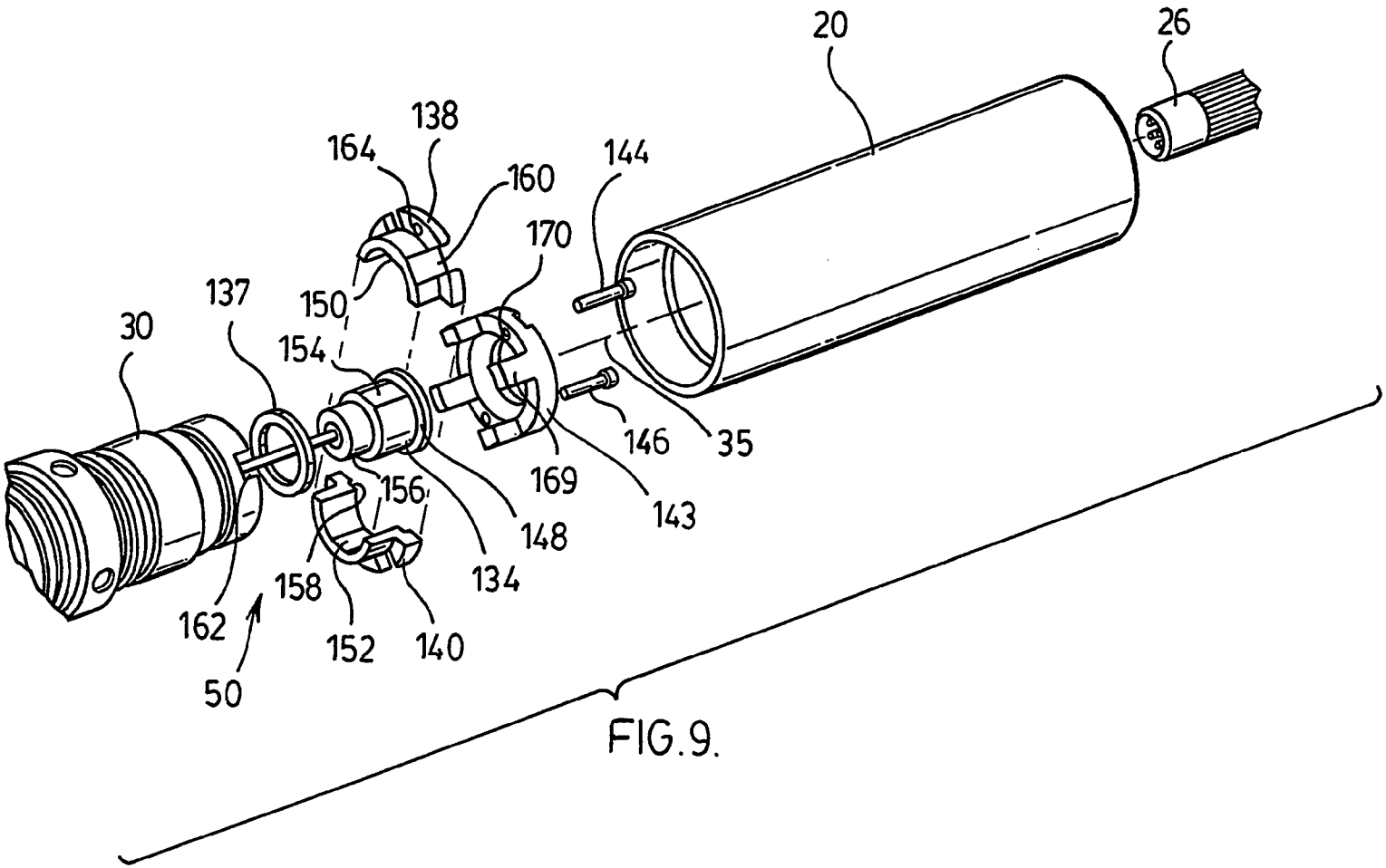
FIG. 9 is an exploded perspective view of flat flange assembly.

FIG. 9 shows an exploded view of the flat flange assembly (50) comprising an O-ring (137), a socket connector (134), two split rings (138, 140), a flat socket flange (143) and two retaining bolts (144, 146). The flat flange assembly (50) serves to retain the socket connector (134) in place on the tool module bulkhead (30). To provide a seal, an O-ring (137) is placed between the bulkhead (30) and the socket connector (134) with the O-ring (137) being positioned adjacent to the socket connector shoulder (148). Two split rings (138, 140) are positioned on either side of the socket connector (134), aligning the flat inside surface (150, 152) of the split rings (138, 140) to the respective flat surfaces (154, 156) while also positioning the O-ring (137) adjacent to the circumferential box-shaped groove (158) on the inner face of the split rings (138, 140). The split ring/socket connector assembly is co-axially centered and positioned into the bulkhead (30) aligning the flat exterior face (160) of the split ring (138) with the box-shaped recess (162) on the end face of the bulkhead (30). Alignment of the flat exterior face (160) of the split ring (138) with the box-shaped recess (162) of the end face of the bulkhead (30) ensures alignment of the threaded holes on the end face (not shown) of the bulkhead (30) with the unthreaded holes (164) machined into the split rings (138, 140). The flat socket flange (143) is then attached to the bulkhead (30), fixing into place the split ring/socket connector assembly by means of retaining bolts (144, 146). On one side of the flange, a retaining bolt (144) is passed through unthreaded holes (170, 164) prior to threadably engaging the respective threaded hole machined into the end face of the bulkhead (30). On the other side of the flange, a second retaining bolt (146) threadably engages the bulkhead in a symmetrically identical manner as explained above for the first retaining bolt (144). Lugs (169) fit into the box-shaped recess (162).

Figure 10:
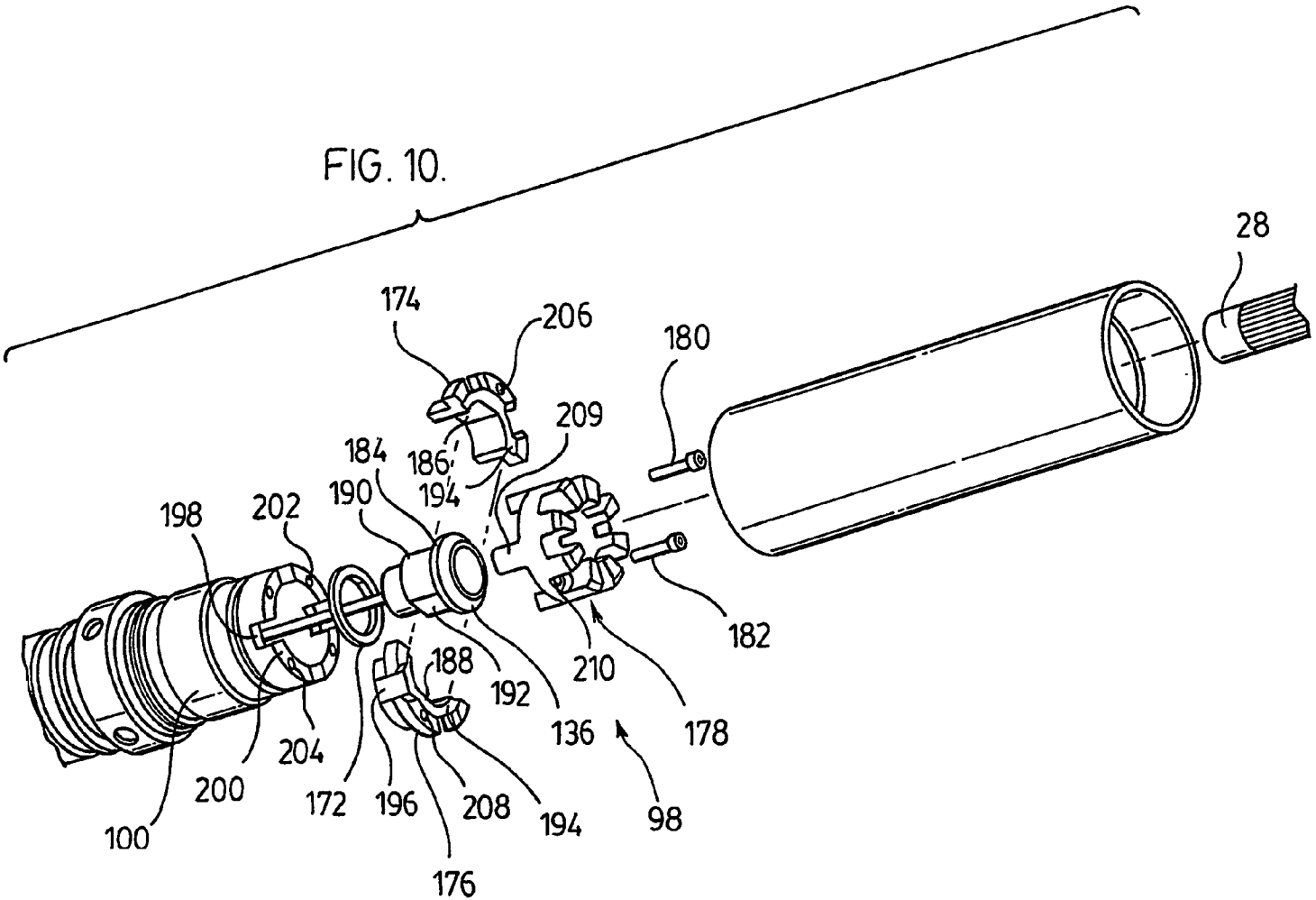
FIG. 10 is an exploded perspective view of the castellated flange assembly.

FIG. 10 shows an exploded view of the castellated flange assembly (98) comprising an O-ring (172), a socket connector (136), two split rings (174, 176), a castellated socket flange (178) and two retaining bolts (180, 182). The castellated flange assembly (98) serves to retain the socket connector (136) in place on the tool module bulkhead (100). To provide a seal, an O-ring (172) is placed between the bulkhead (100) and the socket connector (136) with the O-ring (172) being positioned adjacent to the socket connector shoulder (184). Two split rings (174, 176) are positioned on either side of the socket connector (136), aligning the flat inside surface (186, 188) of the split rings (174, 176) to the respective flat surfaces (190, 192) while also positioning the O-ring (172) adjacent to the circumferential box-shaped groove (194) on the inner face of the split rings (174, 176). The split ring/socket connector assembly is co-axially centered and positioned into the bulkhead (100) aligning the flat exterior face (196) of the split ring (176) with the box-shaped recess (198) on the end face (200) of the bulkhead (100). Alignment of the flat exterior face (196) of the split ring (176) with the box-shaped recess (198) of the end face (200) of the bulkhead (100) ensures alignment of the threaded holes (202, 204) on the end face (200) of the bulkhead (100) with the respective unthreaded holes (206, 208) machined into the respective split rings (174, 176). The castellated socket flange (178) is then attached to the bulkhead (100), fixing into place the split ring/socket connector assembly by means of retaining bolts (180, 182). At the same time, the lugs (209) fit into the box-shaped recess (198) to secure the castellated socket flange (178) from rotation relative to the bulkhead (100). On one side of the flange, a retaining bolt (182) is passed through unthreaded holes (210. 208) prior to threadably engaging the threaded hole (204) machined into the end face of the bulkhead (100). On the other side of the flange, a second retaining bolt (180) threadably engages the bulkhead in a symmetrically identical manner as explained above for the first retaining bolt (182).

Although preferred embodiments of the invention have been described herein in detail, it will be understood by those skilled in the art that variations may be made thereto without departing the spirit of the invention or the scope of the appended claims.

The invention claimed is:

1. A tool module interconnect for interconnecting adjacent tool modules for insertion in a drill string, said interconnect comprising:

an interconnect body;

a means for connecting said interconnect body to adjacent tool modules, wherein said means for connecting said interconnect body to adjacent tool modules comprises at least one rotatable threaded sleeve, said rotatable threaded sleeve being adapted for threaded connection to one of said adjacent tool modules;

an interlock on an end of said interconnect body corresponding to said rotatable threaded sleeve, said interlock engaging said interconnect body end with one of said tool modules; and a wire harness in a longitudinal bore of said interconnect body having at each terminal end connectors where each said connector is floating, unrestricted and accessible from its respective end of the interconnect body;

said interconnect serving to separate the connector from the interconnect body to reduce the transfer of operational stresses and shock to the electrical components of the interconnect.

2. The tool module interconnect of claim 1 further comprising at least one terminal end connector sleeve to maintain said terminal end connectors in position, thus preventing disconnection.

3. The tool module interconnect of claim 1 wherein said wire harness is retractable.

4. The tool module interconnect of claim 3 wherein said wire harness is coiled to promote retraction of said wire harness.

5. The tool module interconnect of claim 4 wherein the coiled wire harness retracts the floating interconnect plug into the longitudinal bore of the interconnect body.

6. The tool module interconnect of claim 1 wherein said means for connecting said interconnect body to adjacent tool modules comprises a fixed threaded region on an end portion of the interconnect body opposite that of said at least one rotatable threaded sleeve.

7. The tool module interconnect of claim 1 wherein a combination of O-rings are used to seal said interconnect body to prevent thereby ingress of drilling mud into said longitudinal bore.

8. The tool module interconnect of claim 1 wherein the rotatable threaded sleeve is spaced from one end, retained on said interconnect body by way of c-clips.

9. The tool module interconnect of claim 8 further comprising a retainer ring to prevent said c-clips from expanding and disconnecting from the interconnect body.

10. The tool module interconnect of claim 1 wherein the interconnect body is a unitary structure extending from one connector end to the other connector end.

11. The tool module interconnect of claim 1 wherein said interlock is a castellated end for said interconnect body end.

12. The tool module interconnect of claim 11 wherein the castellated end of the interconnect body mates with a castellated socket flange secured to a tool module end.

13. The tool module interconnect of claim 11 wherein the other end of said interconnect body is a flat end which mates with a flat flange secured to a tool module end.

14. The tool module interconnect of claim 11 wherein the assembled castellated joint secures said interconnect body from rotating during assembly and use to prevent thereby twisting of said wire harness.

15. The tool module interconnect of claim 1 wherein the connected interconnect and tool module forms a continuous exterior profile.

* * * * *